United States Patent [19]

Daenen

[11] 4,266,354

[45] May 12, 1981

[54] LUGGAGE MARKER

[75] Inventor: Robert H. C. M. Daenen, Hekelgem, Belgium

[73] Assignee: Dart Industries Inc., Los Angeles, Calif.

[21] Appl. No.: 66,899

[22] Filed: Aug. 16, 1979

[51] Int. Cl.[3] ..... G09F 3/14; G09F 3/20

[52] U.S. Cl. ..... 40/21 R; 40/10 R

[58] Field of Search ..... 40/21 R, 21 A, 21 C, 40/304, 5, 6, 10 R

[56] References Cited

U.S. PATENT DOCUMENTS

| | | | |
|---|---|---|---|
| 1,871,064 | 8/1932 | Kipper et al. | 40/21 R |
| 3,231,992 | 2/1966 | Swett | 40/21 R |
| 3,352,040 | 11/1967 | Javkin | 40/21 R |
| 3,686,717 | 8/1972 | Merser | 40/21 R X |

FOREIGN PATENT DOCUMENTS

| | | | |
|---|---|---|---|
| 1468567 | 12/1966 | France | 40/21 R |
| 400473 | 4/1966 | Switzerland | 40/21 R |

*Primary Examiner*—John F. Pitrelli

*Attorney, Agent, or Firm*—Leigh B. Taylor

[57] ABSTRACT

A luggage marker including a strap for providing a strap loop including means for locking the strap in place as it is pulled tight during placement of the luggage marker about the handle of a piece of luggage. The luggage marker preferably includes an integrally molded hinged window for securing and protecting an identification tag within a tag receiving base portion integral with the strap.

6 Claims, 6 Drawing Figures

LUGGAGE MARKER

BACKGROUND OF THE INVENTION

The invention relates to an identification tag, or more particularly, a marker to be attached to the handle or other suitable portion of luggage.

Luggage markers comprised of a unitary member formed of a molded synthetic polymer to be used for identifying luggage have been proposed, particularly for airline baggage identification. These markers generally comprise an elongated strip having a tag receiving portion and a strap portion. The strap is generally integrally molded with the tag receiving portion for securement of the marker to the handle or other suitable portion of a piece of luggage. Various structures have been proposed wherein the strap portion or even part of the tab receiving portion, is looped back upon itself to attach the identification tag to the luggage.

However, a disadvantage of luggage markers of the type described is that no structure is provided for securing, or locking the marker strap in place as it is secured to a piece of luggage.

SUMMARY OF THE INVENTION

The present invention contemplates an improved luggage marker including an integrally molded hinged window for protecting an identification indicia bearing tag in secured relation between the window and a window receiving base member. An integral loop forming strap portion provided with means for locking a loop formed by the strap as the strap is tightened about a handle, or other suitable portion, of a piece of luggage is provided.

The provision of the locking means materially assists in assuring that the luggage marker is not significantly movable along the portion of the luggage to which it is secured. This greatly reduces the likelihood of the luggage marker attaching strap portion being excessively weakened by abrasion or being snared and thus severed as often naturally occurs when a luggage marker loosely slides back and forth along the handle of a piece of luggage.

BRIEF DESCRIPTION OF THE DRAWINGS

A better understanding of this invention as well as many further features and advantages thereof will be had by now referring to the accompanying drawings in which.

DETAILED DESCRIPTION OF THE PREFERRED EMBODIMENT

Figure 1:
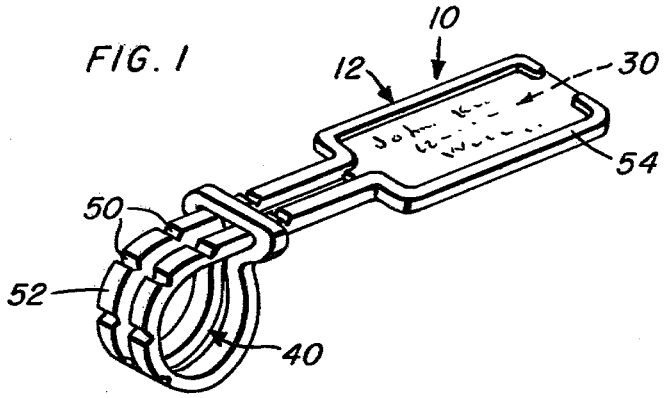
FIG. 1 is a perspective view of a preferred embodiment of a luggage marker of this invention as secured in locked relation to a handle, not shown, of a piece of luggage.
Figure 2:
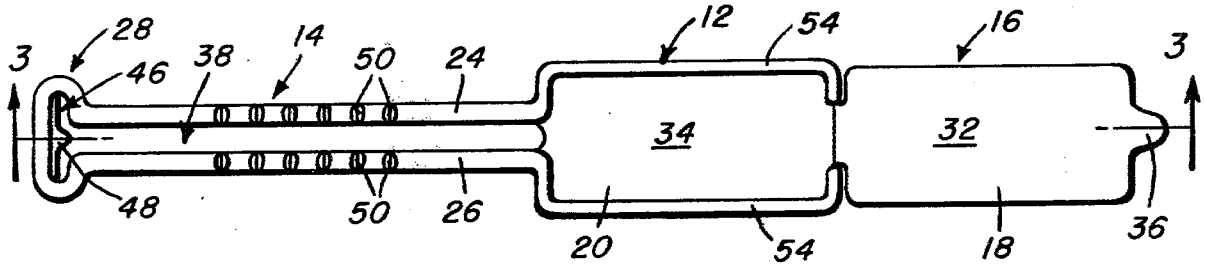
FIG. 2 is a top plan view of the luggage marker, as in flat extended position, prior to operative cooperative engagement of portions thereof.

Referring first to FIGS. 1 and 2, the luggage marker indicated generally at 10 comprises an indicia receiving body portion indicated generally at 12 preferably having integrally formed therewith an elongated bifurcated strap indicated generally at 14 for fastening the luggage marker 10 to a piece of luggage, not shown, such as by securement to a portion of the luggage, e.g., a handle, in a manner as will become clear as the description proceeds.

The preferred embodiment 10 of the luggage marker includes means indicated generally at 16 for securing and protecting an indicia bearing tag to be placed within the body portion 12. In the preferred embodiment illustrated, the securing and protecting means 16 comprises an elongated window 18 integral with a base wall 20 of the body portion 12 and wherein such attachment of the window 18 to the base wall 20 is by means of a hinge 22 of reduced transverse dimension for reasons as will become clear as the description proceeds.

Figure 3:
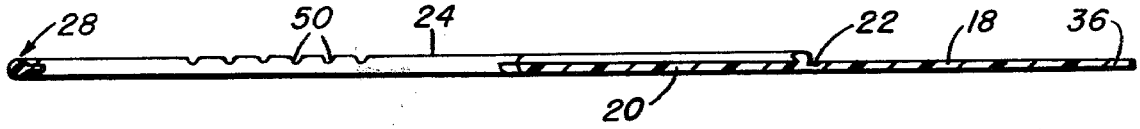
FIG. 3 is a vertical longitudinal cross section taken in the direction of the arrows 3—3 of FIG. 2.
Figure 6:
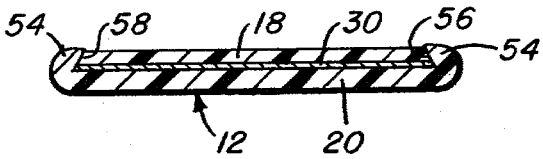
FIG. 6 is an enlarged vertical transverse cross section taken in the direction of the arrows 6—6 of FIG. 4 particularly showing details of means for securing an indicia bearing tag within a plate portion of the luggage marker of this invention.

In the preferred embodiment illustrated, the elongated bifurcated strap indicated generally at 14 includes strap legs 24 and 26 which strap legs distal to their attachment to the body portion 12 are provided with a bight portion 28. As seen from a simultaneous consideration of FIGS. 1 and 2, and at least one additional FIGURE to be described in detail, an indicia bearing tag indicated generally at 30 such as comprising heavy weight paper stock, cardboard, etc., and bearing a name and address, for example, is shown in secured and protected position trapped between the surface 32 of the window 18 and the surface 34 of the base wall 20. In the preferred embodiment 10 of the luggage marker, window 18 is provided with a longitudinally extending tab 36 and means to be described in greater detail hereinbelow are provided for providing latching engagement of the window 18 and the body portion 12 with an indicia bearing tag 30 trapped therebetween. As best seen in FIG. 3, the hinge 22 comprises a transversely extending region of reduced thickness relative to the thickness of the window 18 so as to facilitate positioning the window 18 as illustrated in FIGS. 1, 4 and 6.

Figure 4:
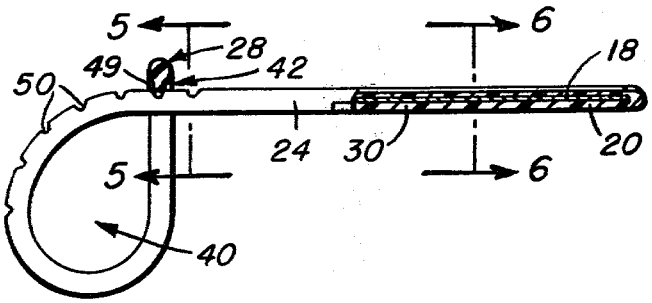
FIG. 4 is a vertical longitudinal cross section of the luggage marker of this invention particularly showing a preferred embodiment of a strap locking mechanism.
Figure 5:
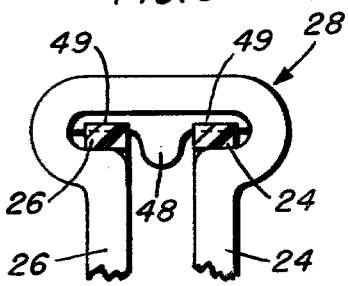
FIG. 5 is an enlarged fragmentary vertical transverse cross section taken in the direction of the arrows 5—5 of FIG. 4 particularly showing specific details of the strap locking mechanism.

Turning now to a description of FIGS. 4 and 5, taken together with the simultaneous consideration of the foregoing FIGURES and particularly FIG. 1, it will be understood that the elongated slot indicated generally at 38 provided by the peripheral portions comprising the body portion 12, strap legs 24 and 26 and strap bight portion 28 is dimensioned so as to allow the passage of the body portion 12 therethrough wherein as best seen from a simultaneous consideration of FIGS. 1, 4 and 5, the strap legs 24 and 26 are turned-back upon themselves with the strap legs 24 and 26 passing through the bight portion of the bifurcated strap 14 for providing a strap loop indicated generally at 40 for fastening the luggage marker 10 about a portion of a piece of luggage, not shown, such as for example in encircling engagement relative to a handle.

A significant aspect of the invention resides in the provision of means indicated generally at 42 for selectively fixing the dimension of the strap loop 40 whereby the strap will lock in encircling engagement to the luggage handle, or the like, so as to materially assist in reducing the likelihood of the luggage marker 10 becoming detached from a piece of luggage such as by being excessively weakened by abrasion by movement back and forth across the luggage handle or by the straps defining the luggage loop 40 being snared and possibly severed such as oftentimes occurs during the handling of luggage while in the possession of a common carrier.

In the preferred embodiment 10 illustrated, the means 42 for selectively fixing the dimension of the strap loop further comprises lock means indicated generally at 44 for releasably securing the bight portion 28 relative to the strap legs 24 and 26. In this regard, the bight portion 28 in connection with the ends of the strap legs 24 and 26 distal to the body portion 12 define a transversely extending elongated slot 46 dimensioned so as to receive the strap legs 24 and 26 therein. The bight portion 28 includes an integral bight tab portion 48 that projects into the bight slot 46, which tab 48 is dimensioned so as to preclude displacement of the strap legs 24 and 26 from their operative position as best appreciated from the simultaneous consideration of FIGS. 1 and 5.

The strap legs 24 and 26 in the preferred embodiment 10 include generally aligned transverse notches 50 provided in, what in the operative placement of the strap comprises the outer surface 52 of the strap loop 40 and wherein the transverse notches 50 coact with the bight tab 48 to provide a detent means wherein the laterally disposed portions 49 of the bight tab 48 snap-lock into respective associated transverse notches 50 as the strap loop 40 is reduced in dimension by being pulled tight about the luggage handle by pulling on the body portion 12 in the direction of the arrow shown adjacent thereto in FIG. 1. From a further consideration of FIGS. 1 and 5, it will be seen that the transverse notches 50 by virtue of providing regions of reduced thickness provide one-way hinging of the strap legs 24 and 26 so as to facilitate formation of the strap loop 40.

Turning now to a specific description of FIG. 6, taken together with the foegoing description of FIGS. 1 and 2 in particular, it will be seen that the body portion 12, and more specifically the base wall 20 includes an upstanding peripheral, generally circumferentially extending wall portion 54, which is best seen in FIG. 6, is provided with a downwardly and outwardly inclined inner wall surface 56 for reception of the window 18 provided with longitudinally extending edge wall surfaces 58 complementary to the surfaces 56 so as to provide the above-mentioned means for providing latching engagement of the window 18 and the body portion 12.

In a preferred embodiment of the luggage marker 10 it would be molded by conventional techniques from a flexible or resilient material such as low density polyethylene or low density polyethylene having a suitable amount of E.V.A. added for additional strength or toughness and wherein in the event the luggage marker incorporating the means 42 for selectively fixing the dimension of the strap loop 40 includes a window 18 the polymer and/or thickness of the window 18 will be such as will permit viewing of indicia on the tag 30, which does not comprise a portion of this invention, through the window 18 when the window is operatively positioned as shown in FIGS. 1, 4 and 6. It will further be appreciated that the window tab 36, in the event a window 18 is provided, facilitates disengagement of the window from the base portion to remove and/or change the tag 30.

It will be understood that while the preferred material of construction for the luggage marker 10 is a polymer, a mixture of polymers, etc., as referenced above, other synthetic polymers can be used with equal effectiveness.

Further, while only one specific embodiment has been set forth for purposes of illustration, it is to be understood that changes and alterations as fall clearly within the scope and spirit of this invention, and particularly the means 42 for selectively fixing the dimension of the strap loop, will occur to those skilled in the art. In this respect, it will be appreciated that the surface 34 of the body portion 20 may in and of itself be suitably treated so as to provide a surface upon which indicia may be permanently or removably placed, thus possibly dispensing with the need for the provision of the window 18 and the means for providing latching engagement of the window 18 with the body portion 12.

Accordingly, the luggage marker of this invention is not to be thought of as limited to the exact embodiment set forth.

I claim:

1. A unitary molded luggage marker comprising an elongated indicia receiving body portion, an axially extending elongated bifurcated strap having spaced apart legs defining an axially extending slot, said strap extending axially from said body portion, said strap legs distal to said body portion being closed by a bight portion defining a transversely extending elongated slot, the bifurcation of the strap being dimensioned to allow the passage of the body portion therethrough with the legs received in the opposed end portions of the elongated slot for providing a strap loop for fastening the marker to a piece of luggage, means integral with the strap for selectively fixing the dimension of a loop so formed as the strap is pulled tight, said means for selectively fixing the dimension of a strap loop formed comprising lock means carried by said bight portion and said legs for releasably securing said bight portion relative to said spaced apart legs of said elongated bifurcated strap, said lock means including a tab means carried by said bight portion and comprising a transversely extending axially disposed and projecting tab for coaction with tab detent means, said detent means being carried by said strap legs on a surface thereof that upon formation of a strap loop is on the outer surface of the strap loop, said detent means comprising aligned pairs of transverse notches in said strap legs whereby formation of a strap loop is facilitated by a hinging effect provided by said notches, and said transversely extending axially disposed and projecting tab including an intermediate portion sized to maintain said legs in said transversely extending slot with the tab lockingly engaged in a pair of aligned notches in said strap legs.

2. A luggage marker according to claim 1 including means for securing and protecting an identification indicia bearing tag within said body portion.

3. A luggage marker according to claim 2, in which said securing and protecting means comprises a window member sized to be press fit into latching engagement with said body portion with an indicia bearing tag secured therebetween.

4. A luggage marker according to claim 2, in which said tag securing and protecting means comprises a window member integral with said body portion.

5. A luggage marker according to claim 4, in which said window member is hinged to said body portion.

6. A luggage marker according to claim 1, in which the marker is formed of molded synthetic polymer.

* * * * *